US007112112B2

(12) United States Patent
Fujita et al.

(10) Patent No.: US 7,112,112 B2
(45) Date of Patent: Sep. 26, 2006

(54) METHOD AND APPARATUS FOR MAKING A SPARK PLUG WITH A PREDETERMINED SPARK GAP

(75) Inventors: Shigeo Fujita, Nagoya (JP); Shinichiro Mitsumatsu, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 137 days.

(21) Appl. No.: 10/601,960

(22) Filed: Jun. 24, 2003

(65) Prior Publication Data

US 2004/0029480 A1 Feb. 12, 2004

(30) Foreign Application Priority Data

Jun. 25, 2002 (JP) ..... 2002-184387

(51) Int. Cl.
*H01T 21/02* (2006.01)
*H01T 21/00* (2006.01)
*H01T 21/06* (2006.01)

(52) U.S. Cl. ..... 445/7

(58) Field of Classification Search ..... 445/763, 445/66–67, 69, 3, 4, 7
See application file for complete search history.

(56) References Cited

U.S. PATENT DOCUMENTS 5,741,963 A * 4/1998 Nakatani et al. ..... 73/118.1
6,193,575 B1 * 2/2001 Nakatani ..... 445/4
6,592,418 B1 * 7/2003 Ito et al. ..... 445/4
6,893,310 B1 * 5/2005 Nakatani ..... 445/7

FOREIGN PATENT DOCUMENTS

| | | | |
|---|---|---|---|
| JP | 3-64882 A | | 3/1991 |
| JP | 8-153566 A | | 6/1996 |
| JP | 11-121143 A | | 4/1999 |
| JP | 2000-164320 A | | 6/2000 |
| JP | 2000-164322 | * | 6/2000 |
| JP | 2000-164322 A | | 6/2000 |
| JP | 2000-182749 A | | 6/2000 |
| WO | WO 01-93389 A1 | | 12/2001 |

* cited by examiner

*Primary Examiner*—Mariceli Santiago
*Assistant Examiner*—Elizabeth Rielley
(74) *Attorney, Agent, or Firm*—Sughrue Mion, PLLC

(57) ABSTRACT

A method for making a spark plug is provided. The method comprises the steps of, for adjustment of a spark gap, provisionally pressing a ground electrode toward a leading end surface of a center electrode and thereby decreasing the spark gap to a predetermined value larger than a final target gap gt, after the step of provisionally pressing the ground electrode, performing an adjustment bending process for eliminating an eccentricity δ of the ground electrode in the widthwise direction thereof with respect to a target position, after the step of performing the adjustment bending process, measuring a spark gap g1 and measuring a difference (g1−gt) between the measured spark gap g1 and the final target gap gt, and pressing the ground electrode toward the center electrode when the difference (g1−gt) is positive. An apparatus for carrying out the method is also provided.

15 Claims, 15 Drawing Sheets

METHOD AND APPARATUS FOR MAKING A SPARK PLUG WITH A PREDETERMINED SPARK GAP

BACKGROUND OF THE INVENTION

The present invention relates to a method and apparatus for making a spark plug.

In a spark plug for use in an internal combustion engine, the accuracy in positioning a ground electrode and a center electrode is important. For example, there possibly occurs such a case in which the center lines of the ground electrode and center electrode with a spark gap being disposed therebetween are eccentric due to defective bending of the ground electrode, displacement of a noble metal attached to one of or each of the electrodes, etc. Such eccentricity will lead to, for example, a short life due to a partial electrode consumption and a trouble of misfire. Further, a spark gap larger than a predetermined value requires an excessively high discharge voltage so as to disable the spark plug to fire. On the other hand, a spark gap smaller than a predetermined value tends to cause short of the spark gap, etc.

For adjustment of the eccentricity between the electrodes and the spark gap, it is known a method of treating the ground electrode by an adjustment bending by means of a bending machine having a pressing punch. For example, in Japanese Patent Unexamined Publication No. 3-64882 is disclosed a method of repeatedly pressing the ground electrode by means of a pressing punch until the spark gap is adjusted to a target value while monitoring the spark gap by means of a CCD camera. In this instance, a target spark gap is set smaller than an ideal spark gap by a predetermined value with consideration of spring back of the ground electrode upon release of a pressing force on the ground electrode.

In Japanese Patent Unexamined Publication No. 11-121143 is disclosed a method of calculating the eccentricity of the center line of the noble metal chip disposed at the ground electrode and the center line of the center electrode after inspection of the spark gap and adjusting the position of the ground electrode in the width direction thereof.

SUMMARY OF THE INVENTION

The bending process for adjusting the eccentricity between the ground electrode and the center electrode through adjustment of the position of the ground electrode in the width direction thereof is performed by measuring the eccentricity δ between the electrodes by image processing, etc. and performing the bending process by the adjustment amount μ and in the direction so as to eliminate the eccentricity δ. However, the bending process may possibly cause the spark gap to increase or decrease and in many cases cause the spark gap to decrease. Namely, if the adjustment of the position of the ground electrode in the widthwise direction thereof is performed after the ground electrode is pressed toward the leading end surface of the center electrode so as to adjust the spark gap to a final target value gt, there is a possibility that the spark gap is deviated from the final target value gt and becomes smaller than the same. If the spark gap is larger than the final target value gt, adjustment of the spark gap can be made by applying a force on the outer surface side of the ground electrode, i.e., the side opposite to the spark gap defining side. However, if the spark gap is smaller than the target gap gt, it is necessary to bend the ground electrode outward by an adjustment jig disposed on the spark gap defining side of the ground electrode or by an adjustment jig that has portion brought into contact with the widthwise end surfaces and tightly holding therebetween the ground electrode. In either case, if the spark gap has become smaller than the final target value gt, adjustment of the spark gap inevitably damage the ground electrode and may possibly influence the durability of the spark plug, etc.

On the other hand, if the above-described adjustment amount μ is set equal to the eccentricity δ, the ground electrodes springs back when the pressing force by means of the adjustment jig is released from the ground electrode. Thus, it is necessitated to give a larger adjustment amount μ to the ground electrode in view of the spring back. In other words, the value obtained by subtracting the spring back amount SB from the adjustment amount μ exhibits the displacement amount λ remaining in the ground electrode as a result of adjustment bending. By setting the adjustment amount μ so as to allow the displacement amount λ to become equal to the eccentricity δ, the eccentricity δ can be eliminated. The foregoing can be expressed as follows.

$$\mu=\lambda+SB \tag{1}$$

$$\lambda=\delta \tag{2}$$

From (1) and (2), $$\mu=\delta+SB \tag{3}$$

Since large plastic deformation of metal causes work hardening, elastic deformation upon application of working load becomes larger as the adjustment amount μ becomes larger. Accordingly, the spring back SB of the ground electrode varies depending upon a variation of the adjustment amount μ. Assuming that such varying spring back is represented by SB(μ), the following is obtained from the expression (3).

$$\mu=\delta+SB(\mu) \tag{4}$$

If SB(μ) can be expected logically, the adjustment amount μ to be given to the ground electrode upon the adjustment work thereof can be found from the expected SB(μ) and the measured eccentricity δ. However, the bending process applied to the ground electrode to eliminate the eccentricity thereof cannot generally be approximated to a simple uniaxial tensile deformation, so that it is generally difficult to expect the SB(μ) values corresponding to various adjustment amounts μ from the stress-strain curve of the material or the like.

It is accordingly an object of the present invention to provide a method of making a spark plug, which never causes a spark gap to become smaller than a final target value even after adjustment of a ground electrode for eliminating an eccentricity thereof is performed.

It is a further object of the present invention to provide a method of making a spark plug, which can eliminate an eccentricity of a ground electrode suitably even when spark plug works differ in eccentricity and in expected spring back amount resulting at the time of a work for adjustment of the eccentricity.

It is a further object of the present invention to provide an apparatus for carrying out the above-described method.

To achieve the above object, there is provided according to an aspect of the present invention a method for making a spark plug having a center electrode disposed inside an insulator, a metallic shell disposed outside the insulator, and a ground electrode having a base end side connected to a leading end surface of the metallic shell and a leading end side bent so as to have a side surface that is opposed to a leading end surface of the center electrode to form therebetween a spark gap, the method comprising the steps of, for adjustment of a spark gap of a spark plug work having the center electrode and the ground electrode, provisionally pressing the ground electrode of the spark plug work toward the leading end surface of the center electrode and thereby decreasing the spark gap to a predetermined value larger than a final target gap gt, after the step of provisionally pressing the ground electrode, performing an adjustment bending process for bending the ground electrode in the widthwise direction thereof so as to eliminate an eccentricity δ of the ground electrode with respect to a target position, after the step of performing the adjustment bending process, measuring the spark gap g1 of the spark plug work and measuring a difference (g1−gt) between the measured spark gap g1 and the final target gap gt, and pressing the ground electrode toward the center electrode when the difference (g1−gt) is positive.

By this aspect of the present invention, the adjustment bending process for eliminating the eccentricity of the ground electrode in the widthwise direction thereof never causes the spark gap to become smaller than the target spark gap gt and enables the spark gap adjustment to be obtained with ease.

According to another aspect of the present invention, there is provided a method of making a spark plug having a center electrode and a ground electrode having a base end side joined to an end surface of a metallic shell and a leading end side opposed to the center electrode so as to form a spark gap therebetween, the method comprising performing an adjustment bending process of a plurality of spark plug works having the center electrodes and the ground electrodes for making adjustments of positions of the ground electrodes in the width direction thereof by adjustment amount μ, measuring resulting displacement amounts λ of the ground electrodes in the width direction thereof and finding the adjustment amount μ from μ=F(λ) that is a function of the displacement amount λ, and finding an adjustment amount necessary for eliminating the eccentricity δ of the ground electrode with respect to a target position based on the adjustment amount function μ=F(λ).

By this aspect of the present invention, by experimentally determining the adjustment amount μ so as to be obtained from the adjustment amount function μ=F(λ) of only the displacement amount λ, thereby determining the function considering the spring back amount from the first, the adjustment amount μ corresponding to the measured eccentricity δ can be found from the adjustment amount function μ=F(λ) with ease. For example, even if spark plug works differ in the eccentricity of the ground electrode that is required to be eliminated and in the spring back amount that is expected to be caused at the adjustment bending process, the adjustment amount μ considering the spring back amount can be determined with ease by substituting λ of the adjustment function μ=F(λ) for δ. By the adjustment bending process of the thus obtained adjustment amount μ, the eccentricity δ can be eliminated efficiently.

According to a further aspect of the present invention, there is provided an apparatus for making a spark plug having a center electrode disposed inside an insulator, a metallic shell disposed outside the insulator, and a ground electrode having a base end side connected to a leading end surface of the metallic shell and a leading end side bent so as to have a side surface that is opposed to a leading end surface of the center electrode to form therebetween a spark gap, the apparatus comprising a pair of first and second pressing devices for adjustment of a spark gap of a spark plug work having the center electrode and the ground electrode, a bending device for adjustment of an eccentricity of the ground electrode of the spark plug work, and a controller for controlling the first and second pressing devices and the bending device, the controller being programmed to actuate, for adjustment of the spark gap of the spark plug work, the first pressing device to provisionally press the ground electrode of the spark plug work toward the leading end surface of the center electrode and thereby decrease the spark gap to a predetermined value larger than a final target gap gt, actuate, after the provisional pressing of the ground electrode, the bending device to perform an adjustment bending process for bending the ground electrode in the widthwise direction thereof so as to eliminate an eccentricity δ of the ground electrode with respect to a target position, measure, after the adjustment bending process, a spark gap g1 of the spark plug work and measure a difference (g1−gt) between the measured spark gap g1 and the final target gap gt, and actuate the second pressing device to press the ground electrode toward the center electrode when the difference (g1−gt) is positive.

According to a further aspect of the present invention, there is provided an apparatus for making a spark plug having a center electrode and a ground electrode having a base end side joined to an end surface of a metallic shell and a leading end side opposed to the center electrode so as to form a spark gap therebetween, the apparatus comprising means for performing an adjustment bending process of a plurality of spark plug works having the center electrodes and the ground electrodes for making adjustments of positions of the ground electrodes in the width direction thereof by adjustment amount μ, means for measuring resulting displacement amounts λ of the ground electrodes in the width direction thereof and finding the adjustment amount μ from μ=F(λ) that is a function of the displacement amount λ, and means for finding an adjustment amount necessary for eliminating the eccentricity δ of the ground electrode with respect to a target position based on the adjustment amount function μ=F(λ).

DESCRIPTION OF THE PREFERRED EMBODIMENTS

Figure 1:
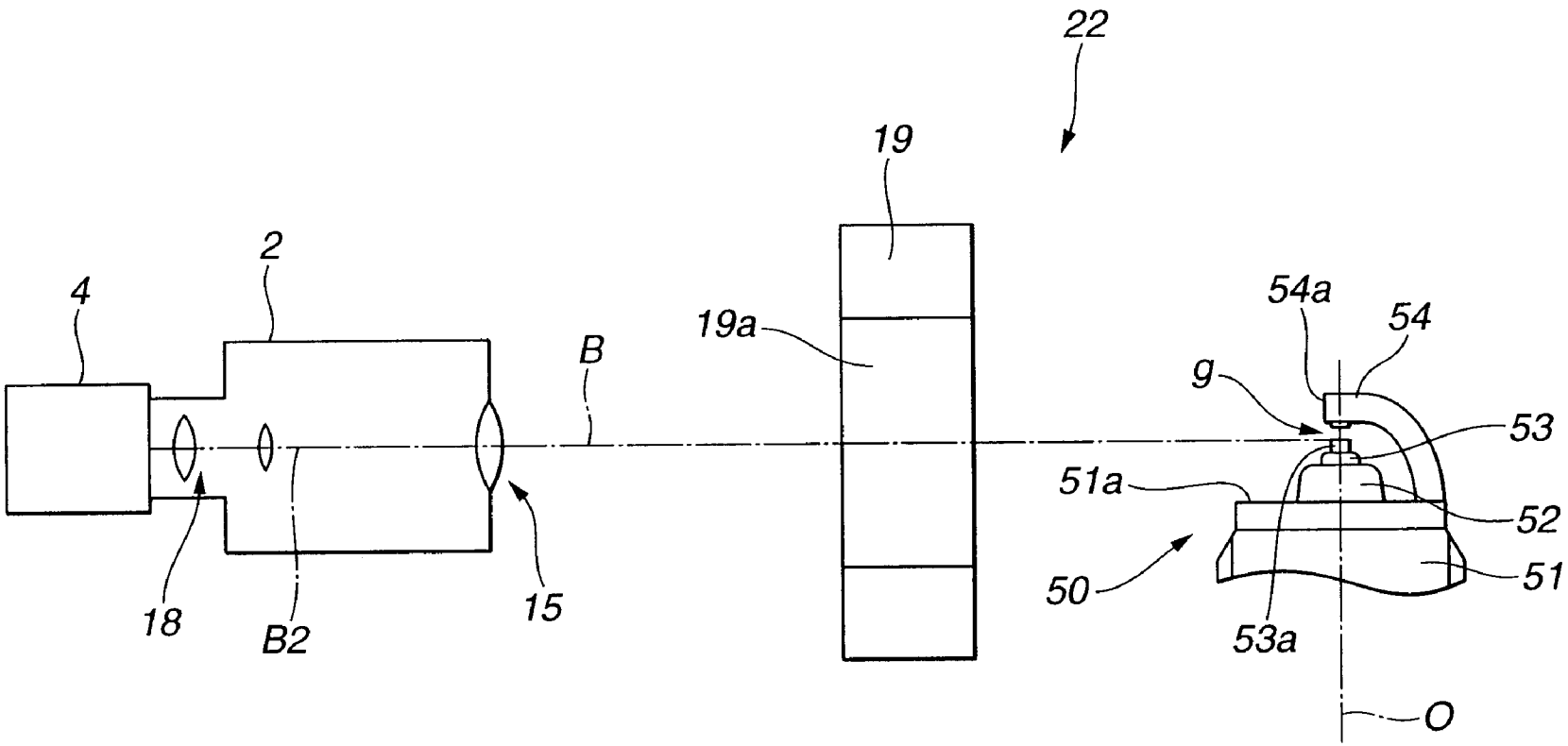
FIG. 1 is a schematic view of an electronic photography system of an apparatus for carrying out a method of making a spark plug according to the present invention.

FIG. 1 shows an electronic photography system 22 of an apparatus 1 for carrying out a method of making a spark plug according to an embodiment of the present invention. In the figure, a spark plug (hereinafter also referred to simply as work) 50 includes a center electrode 53 that is disposed inside an insulator 52 and a ground electrode 54 that has a base end side attached to a leading end surface 51*a* of a metallic shell 51 disposed outside the insulator 52. The ground electrode further has a leading end side disposed opposite to the center electrode 53 so as to form a spark gap g between the center electrode 53 and the ground electrode 54. More specifically, the work 50 is of such a kind that the ground electrode 54 is bent toward the center electrode 53 side so as to have a leading end side surface that faces the leading end surface of the center electrode 53 and form therebetween a spark gap g. In this embodiment, the leading end portion of the center electrode 53 is comprised of a noble metal chip 53*a* (hereinafter also referred to as leading end portion 53*a*) made of a Ni alloy and welded to a leading end of a center electrode main body (no numeral).

The photography system 22 includes a light 19 and a camera 4. The camera captures an image VA of the work 50 while lighting the work 50 by the light 19.

Based on the image VA obtained by this photography operation, information on the positions of the ground electrode 54 and the center electrode 53 is analyzed and acquired. The analysis and acquisition of the information on the positions is executed by a computer 10 (refer to FIG. 2) that functions as an analysis device and a control device.

Figure 3:
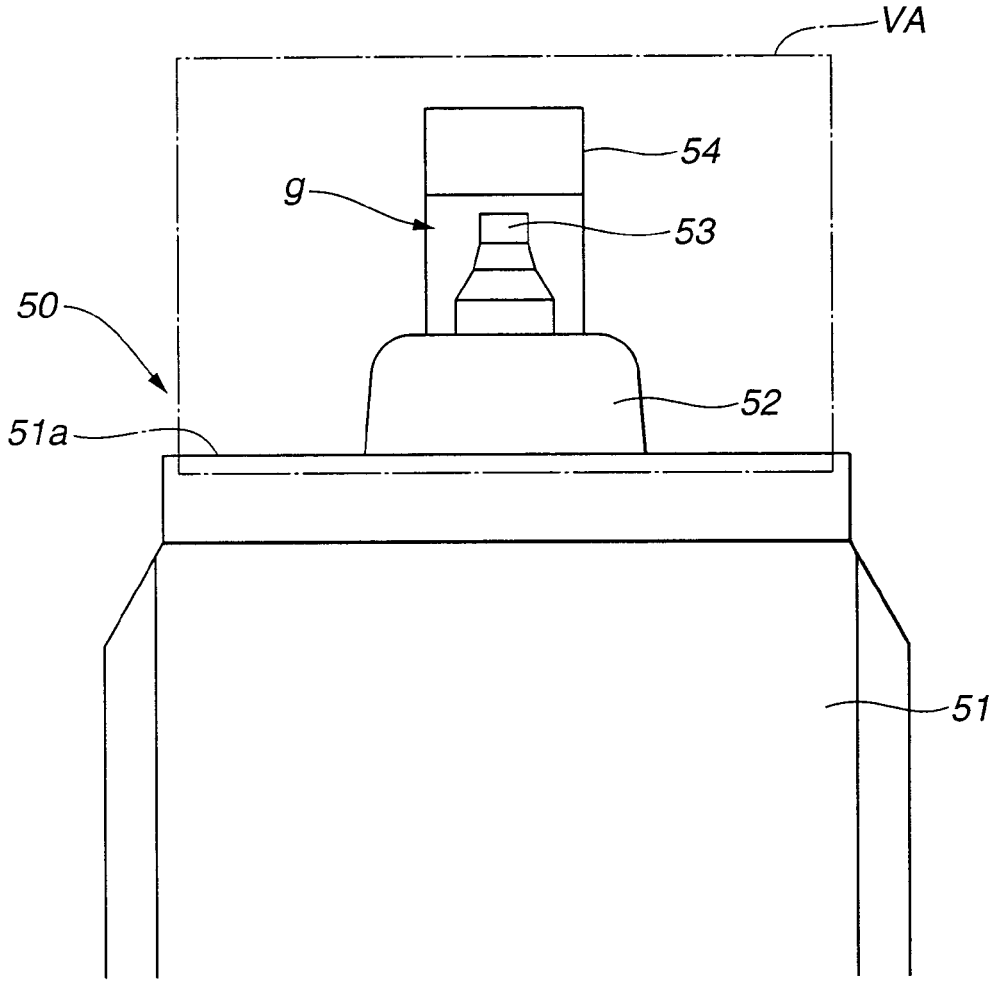
FIG. 3 is a schematic view showing a field of vision of a camera.

Referring again to FIG. 1, in this embodiment, the eccentricity between the ground electrode 54 and the center electrode 53 is measured as the eccentricity of the ground electrode 54. Assuming that the frontal direction of the camera 4 indicates the direction in which the center electrode 53, when viewed from the camera 4, is positioned rearward of the base end portion of the ground electrode 54 and in which the center electrode 53 and the ground electrode 54 are overlaid one upon another, the camera 4 takes a photograph of the spark gap g of the work 50 and its surroundings in the above-described frontal direction. As shown in FIG. 3, when a photograph is taken with the camera 4 set in the above-described direction, the image of the place where the center electrode 53 faces the spark gap g appears on this side of the image of the ground electrode 54 while being laid over the same.

Referring again to FIG. 1, the light 19 throws a light in the frontal direction and upon the leading end face 54*a* of the ground electrode 54. In this embodiment, the light 19 is a LED light consisting of a surface luminous type LED or a number of light-emitting elements that are arranged on a plane and is formed with a through hole section or a transparent section at a position where an image beam B passes.

As shown in FIG. 1, the camera 4 is attached to a lens unit 2. Within the lens unit 2 is provided an objective optical system 15 for the work 50. The image beam B introduced into the objective optical system 15 is enlarged by an image forming optical system 18 and thereafter captured by the camera 4.

Figure 2:
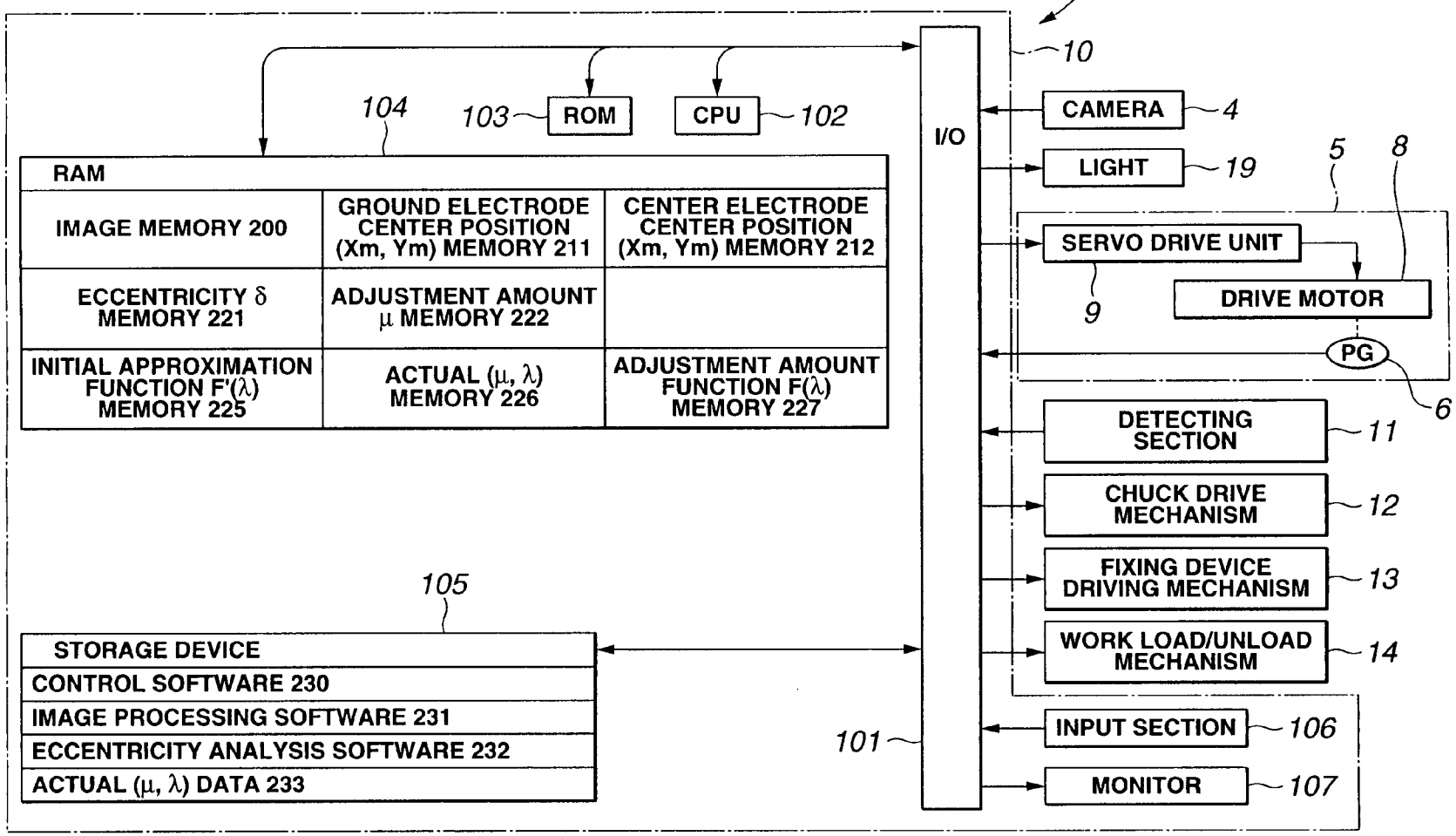
FIG. 2 is a block diagram showing a main control section of the apparatus for controlling an adjustment bending device that is used in the method of the present invention for performing an adjustment bending process.

FIG. 2 shows a main control section for an adjustment bending device 5 of the apparatus 1. The adjustment bending device 5 is used for performing an adjustment bending process. The apparatus 1 includes the computer 10 that functions as the above-described analysis device and a control section for controlling the adjustment bending device 5. The computer 10 includes a CPU 102, a ram 104 that provides a work area of the CPU 102 and functions as various data memories 200, 211, 212, 221, 222, 225, 226, 227 that are used in a control process and an analysis process, a ROM 103 that stores a basic computer operating system program, and an input interface 101. A control software 230 that realizes a control function of the apparatus 1 is installed in a storage device 105 that is constituted by a hard disk drive, etc. In the storage device 105 are further installed an image processing software 231 that performs an image processing such as a profile line extraction and determination process of the ground electrode 54 or the center electrode 53, and an eccentricity analysis software 232 that analyses the eccentricity between the ground electrode 54 and the center electrode 53 based on the extracted profile line data. Further, in the storage device 105 are stored actual data 233 on an adjustment amount $\mu$ and displacement amount $\lambda$ that will be described later. Further, to the input/output interface 101 are connected an input section 106 that is constituted by a key board, mouse, etc. (used for input of various settings) and a monitor 107.

Further, to the input/output interface 101 of the computer 10 are connected the above-described camera 4 (that is constituted by a digital camera) and the light 19 (lighting control unit is omitted for brevity). Further, a work load/unload mechanism 14 that performs attaching and detaching of the work to and from a holder 31 (refer to FIG. 4), a fixing device driving mechanism 13, a chuck drive mechanism 12, the adjustment bending device 5 and a detecting section 11 are also connected to the input/output interface 101.

Figure 4:
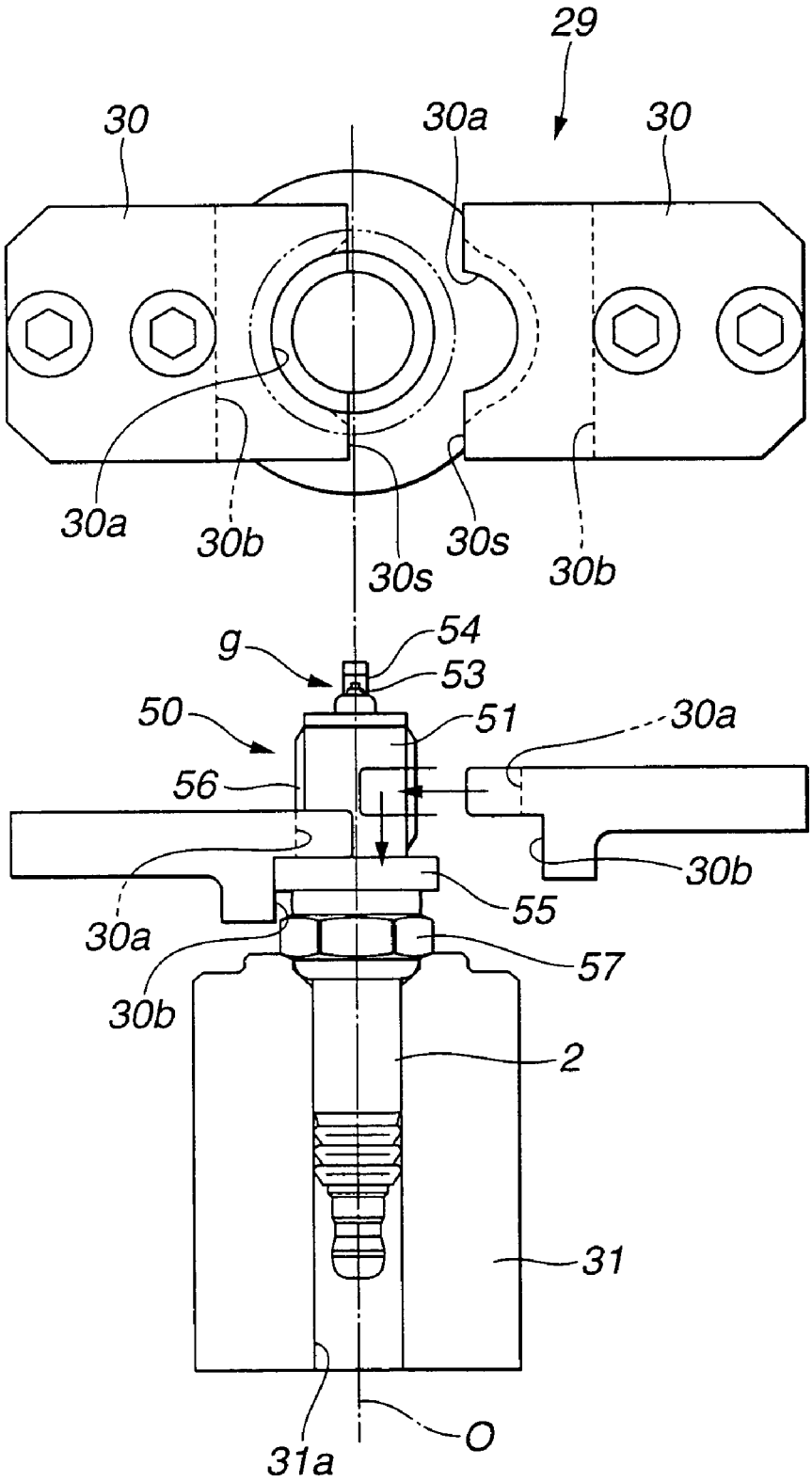
FIG. 4 is a view showing a holder and fixing device for holding a spark plug work.

Referring to FIG. 4, the holder 31 has a work attaching hole 31*a* into which the work 50 is inserted so as to have the spark gap g on an upper side and supports a hexagonal section 57 of a metallic shell 51 at the portion around the open end of the work attaching hole 31*a*. The metallic shell 51 of the work 50 has at a base end side of a threaded portion 56 a protruded portion 55 in the form of an annular flange. A fixing device 29 consists of two separate fixing sections 30, 30 that are joined at joining surfaces 30*s*, 30*s* thereof. The fixing sections 30, 30 are driven by the fixing device driving mechanism 13 so as to be movable horizontally toward and away from the center axis O of the spark plug 50 or the center axis of the work attaching hole 31*a* while being movable together toward and away from the upper end surface of the protruded portion 55 along the direction of the center axis O. In the meantime, the joining surfaces 30*s*, 30*s* are formed with semicircular notches 30*a*, 30*a* for preventing interference with the threaded portion 56. Further, each fixing section 30 has at the lower surface thereof a guide 30*b* extending along the notch 30*a*. The fixing device 29 is used for fixing the work 50 when the adjustment bending process of the ground electrode 54 is to be performed. The fixing device 29 is abuttingly engaged at the lower surfaces around the notches 30*a*, 30*a* with the upper surface of the protruded portion 55 and pushed in the direction of the center axis O toward the holder 31 thereby bringing the work 50 into fitting engagement with the upper surface of the holder 31. Further, the fixing device 29 is abuttingly engaged at inner circumferential surfaces of the guides 30*b*, 30*b* with the outer circumferential surface of the protruded portion 55 thereby restricting movement of the work 50 in the radial direction of the center axis O.

Figure 12A:
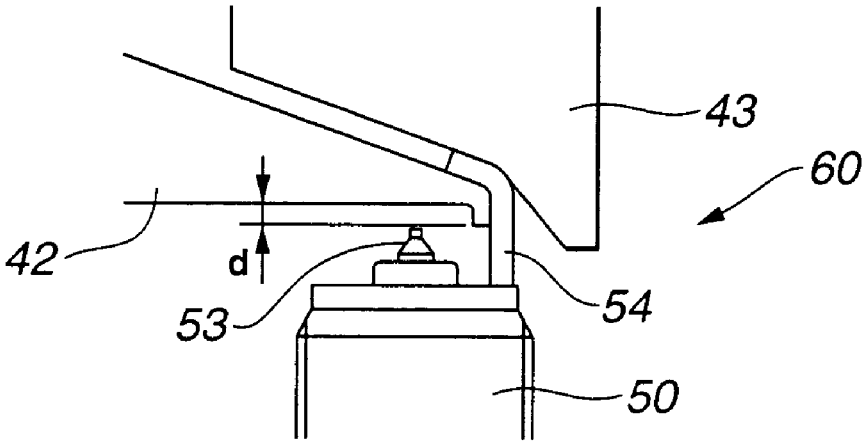
FIGS. 12A and 12B are schematic views of a provisional pressing device.
Figure 12B:
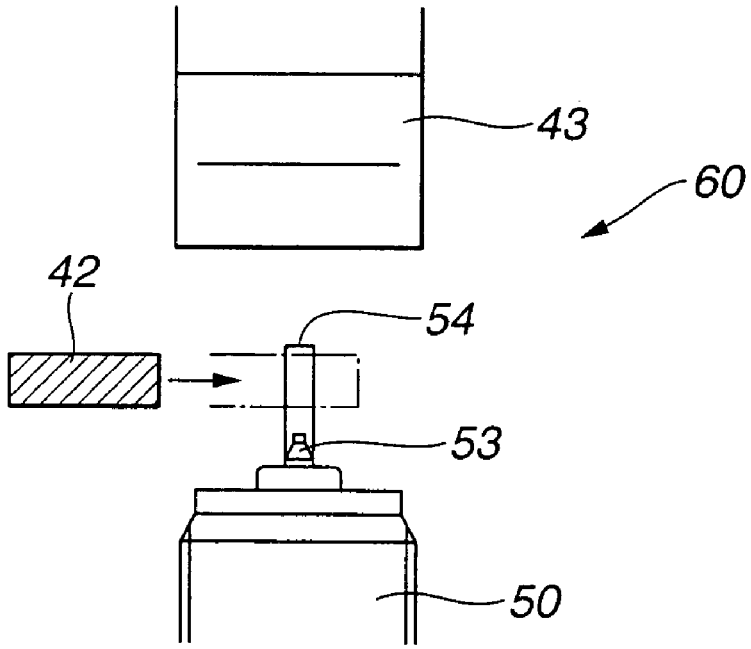

Then, FIGS. 12A and 12B show an example of a provisional pressing device 60. Since the provisional pressing device 60 is known as disclosed in Japanese Unexamined Patent Publication No. 2000-164320, a detailed description thereof is omitted for brevity and only a brief description is made. The provisional pressing device 60 has a provisional pressing spacer 42 that is disposed opposite to the leading end surface of the center electrode 53 of the work 50. Against the provisional pressing spacer 42 is pressed the leading end side of the ground electrode 54 from the opposite side of the center electrode 53 by means of a bending punch 43 thereby performing a provisional pressing process. The provisional pressing device 60 has, though not shown, a provisional pressing spacer positioning mechanism section and a bending mechanism section. The provisional pressing spacer positioning mechanism section positions the provisional pressing spacer 42 so as to provide a predetermined gap d between the leading end surface of the center electrode 53 and the provisional pressing spacer 42. Further, the bending mechanism section drives the bending punch 43 so as to allow the ground electrode 54 to be pressed by the bending punch 43 against the provisional pressing spacer 42 that is positioned by the provisional pressing spacer positioning mechanism section as described above. By selecting the shape of the provisional pressing spacer 42 suitably and performing the provisional pressing process by using the spacer 42 having a selected shape, the gap g between the ground electrode 54 and the leading end surface of the center electrode 53 can be reduced to a predetermined target gap that is larger than a final target gap gt.

Figure 5:
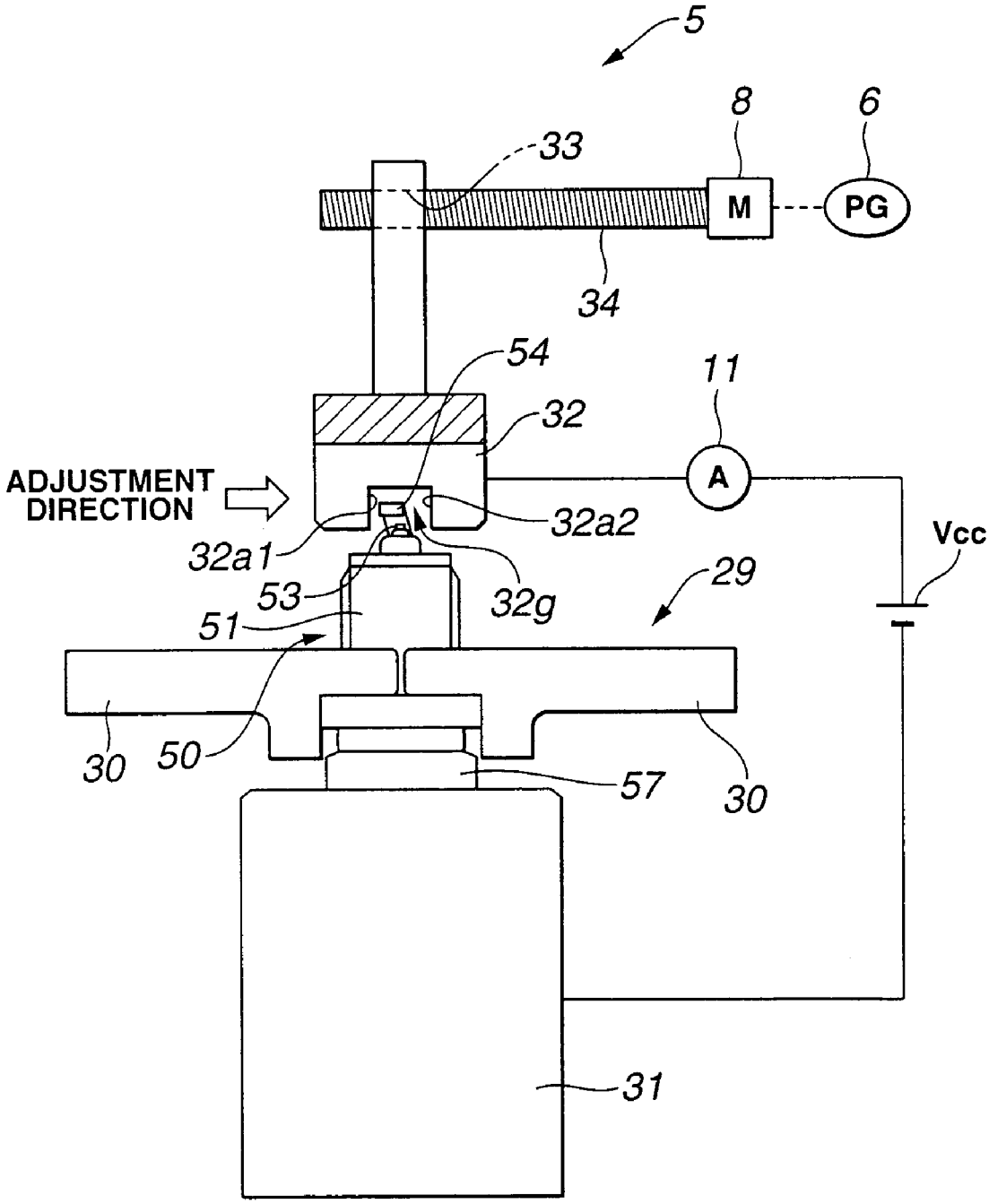
FIG. 5 is a schematic view showing the adjustment bending device of FIG. 2.

As shown in FIG. 5, the adjustment bending device 5 is used for performing the adjustment bending process of the ground electrode 54 and includes a bending tool 32. The bending tool 32 has at the lower surface side thereof a groove 32*g* for receiving therewithin the ground electrode 54. The inner side surfaces of the groove 32*g* that are opposed in the width direction are adapted to serve as bending operation surfaces 32*a*1, 32*a*2 for performing an bending operation in the first and second directions, respectively. The bending tool 32 has, for example, an integral female-threaded portion 33 that is screwed onto or threadedly engaged with a threaded shaft 34. By driving the threaded shaft 34 by means of the drive motor 8 in the opposite first and second directions, the bending tool 32 is abuttingly engaged at the bending operation surfaces 32*a*1, 32*a*2 with the ground electrode 54 and thereby applies a bending force to the ground electrode 54.

The angular position of the drive motor 8 is detected by a pulse generator (PG) 6. As shown in FIG. 2, the servo drive unit 9 of the drive motor 8 is connected to the input/output interface 101 of the computer 10. The angular position of the drive motor 8 is inputted from the pulse generator 6 to the computer 10 as well as to the servo drive unit 9 by way of the input/output interface 101.

Further, in FIG. 2, the detecting section 11 detects contact of the bending tool 32 with the ground electrode 54. For example, as shown in FIG. 5, a detection power source voltage Vcc is applied across the metallic holder 31 and the bending tool 32. The detecting section 11 can be structured so as to detect a current shorted between the bending tool 32 and the holder 31 by way of the ground electrode 54 and the metallic shell 51.

Returning back to FIG. 2, supplied to the serve drive unit 9 from the computer 10 is a drive instruction for driving the serve drive unit 9 in the first direction or second direction according to the direction of adjustment bending of the ground electrode 54. When it is started to drive the drive motor 8, a pulse is inputted from the pulse generator 6 to the computer 10. The ground electrode 54 is initially out of contact with the bending tool 32, so that the detecting section 11 inputs to the computer 10 a signal indicative of having not yet detected the contact. When the drive motor 8 rotates a predetermined amount, the ground electrode 54 and the bending tool 32 are brought into contact with each other, so that a signal indicative of having detected the contact is inputted from the detecting section 11 to the computer 10. It is necessary to give the ground electrode 54 after contacting with the bending tool 32 a displacement amount $\lambda$ corresponding to the adjustment amount $\mu$ that is calculated from the result of the eccentricity measurement that will be described later. Thus, the computer 10 supplies to the servo drive unit 9 at the timing it receives the signal indicative of having detected the contact an instruction for driving the drive motor 8 an angular amount corresponding to the adjustment amount $\mu$. When rotation of the drive motor 8 by that angular amount is completed, the drive motor 8 is driven in the reverse direction to release the ground electrode 54 from the condition of being pressed for bending and the adjustment bending process is finished. In the meantime, there are various control forms for supplying from the computer 10 to the servo drive unit 9 an instruction of finishing the process. For example, a process finishing angular position (or pulse number) is instructed to the servo drive unit 9, and the servo drive unit 9 voluntarily performs counting of the pulse from the pulse generator 6 and recognition of the angular position for finishing the process. On the other hand, the counting of the pulse from the pulse generator 6 can be performed on the computer 10 side, and when the angular position for finishing the process is attained the computer 10 can supply to the servo drive unit 9 an instruction of stopping the drive motor 8 and driving the same in the reverse direction.

When the adjustment bending process is completed, the spark gap g is measured again. If the final target gap gt is not attained, an adjustment bending process is performed by means of an adjustment pressing device 70 shown in FIGS. 13A and 13B thereby adjusting the spark gap to a final target value. The adjustment pressing device 70 pushes the leading end side of the ground electrode 54 from the side thereof opposite to the center electrode 53 by using an adjustment pressing punch 90 thereby performing the adjustment pressing process. The spark gap g1 is measured by means of a camera 92. In the meantime, in the adjustment pressing device shown in FIGS. 13A and 13B, the bending process of the ground electrode 54 can be performed with a knife-like spacer for controlling the gap being interposed between the leading end surface of the center electrode 53 and the leading end portion of the ground electrode 54. However, from the point of view for preventing a defect such as damage of the center electrode 53 that may possibly be caused by contact with the spacer similarly to the provisional bending process, it is desirable to perform the adjustment bending process without using the spacer.

Figure 14:
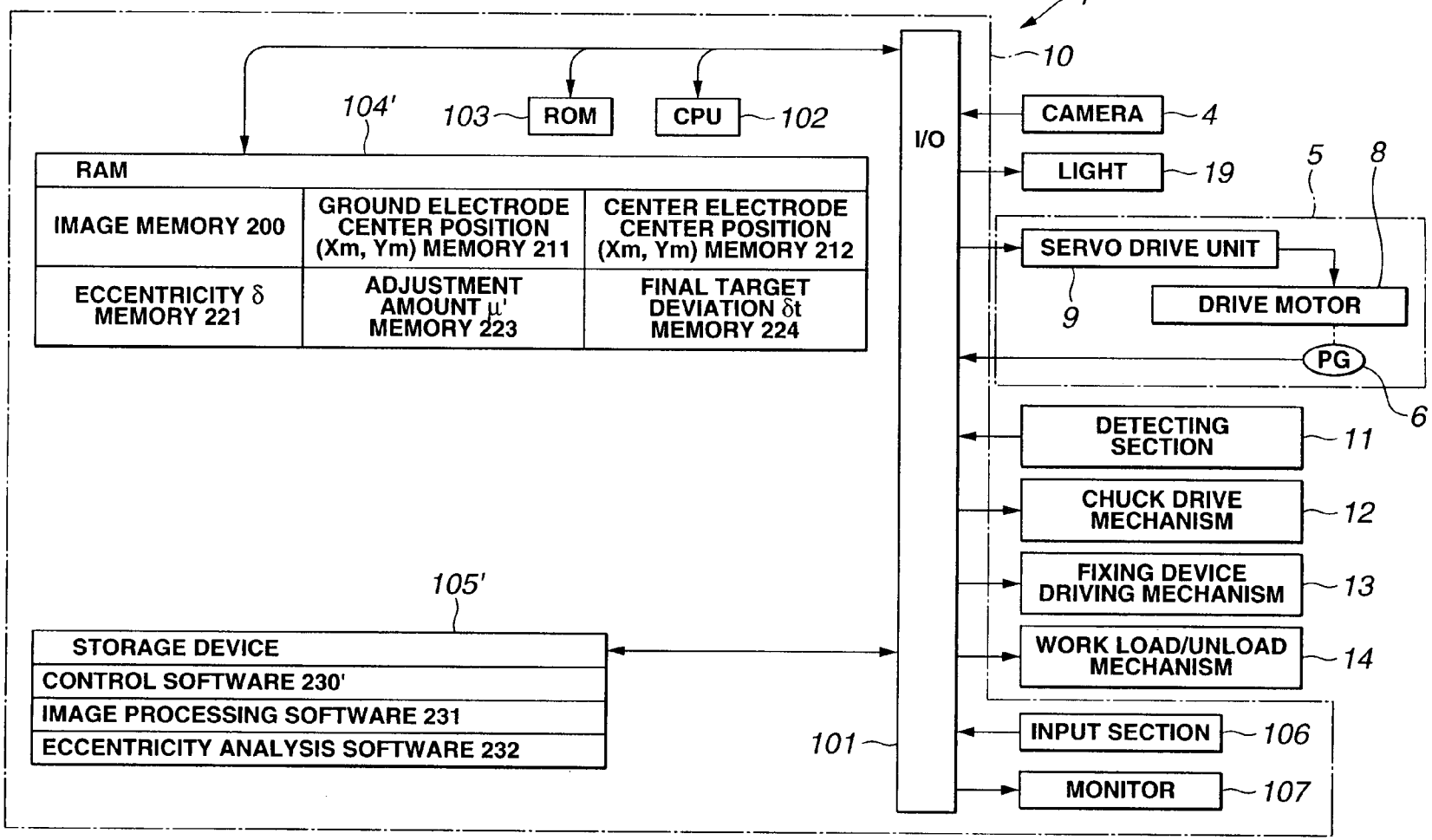
FIG. 14 is a view similar to FIG. 2 but shows a modification of the main control section for the adjustment bending device.

FIG. 14 shows a variation of the main control section shown in FIG. 2. In FIG. 14, like portions to those in FIG. 2 are designated by like reference characters and will not be described again. In the apparatus 1', an adjustment bending process of a predetermined adjustment amount μ' is repeated for correcting the eccentricity δ until it is adjusted to a final target deviation δt. Accordingly, the RAM 104' that functions as a memory of various data does not include the adjustment amount μ memory 222, the initial approximation function F'(λ) memory 225, the actual (μ, λ) memory 226 and the adjustment amount function F(λ) memory 227 but instead thereof includes a predetermined adjustment amount μ' memory 223 and a final target deviation δt memory 224. Further, in the storage device 105' are not stored the actual data 233 on the adjustment amount μ' and displacement amount λ. In the meantime, the final target deviation δt is, for example, determined as a predetermined value having a tolerance of ±0.1 mm.

In the adjustment bending device 5, a drive instruction for driving the drive motor 8 in the normal or reverse direction that is determined according to the direction of adjustment bending of the ground electrode 54 is supplied from the computer 10 to the servo drive unit 9. When counting of the pulse from the pulse generator 6 corresponding to the predetermined adjustment amount μ is detected after the detecting section 11 has detected contact of the bending tool 32 with the ground electrode 54, rotation of the drive motor 8 caused by the servo drive unit 9 is stopped. Then, the drive motor 8 is driven in the reverse direction to release the ground electrode 54 from the condition of being pressed by means of the bending tool 32.

Hereinafter, the method of making a spark plug according to the present invention by using the above-described apparatus 1 will be described. Firstly, by the provisional pressing device 60 shown in FIGS. 12A and 12B, a provisional pressing process is performed by disposing the provisional pressing spacer 42 so as to oppose to the leading end surface of the center electrode 53 and pressing the leading end side of the ground electrode 54 against the provisional pressing spacer 42 by means of the bending punch 43 and from the side of the ground electrode 54 opposite to the center electrode 53.

Figure 6:
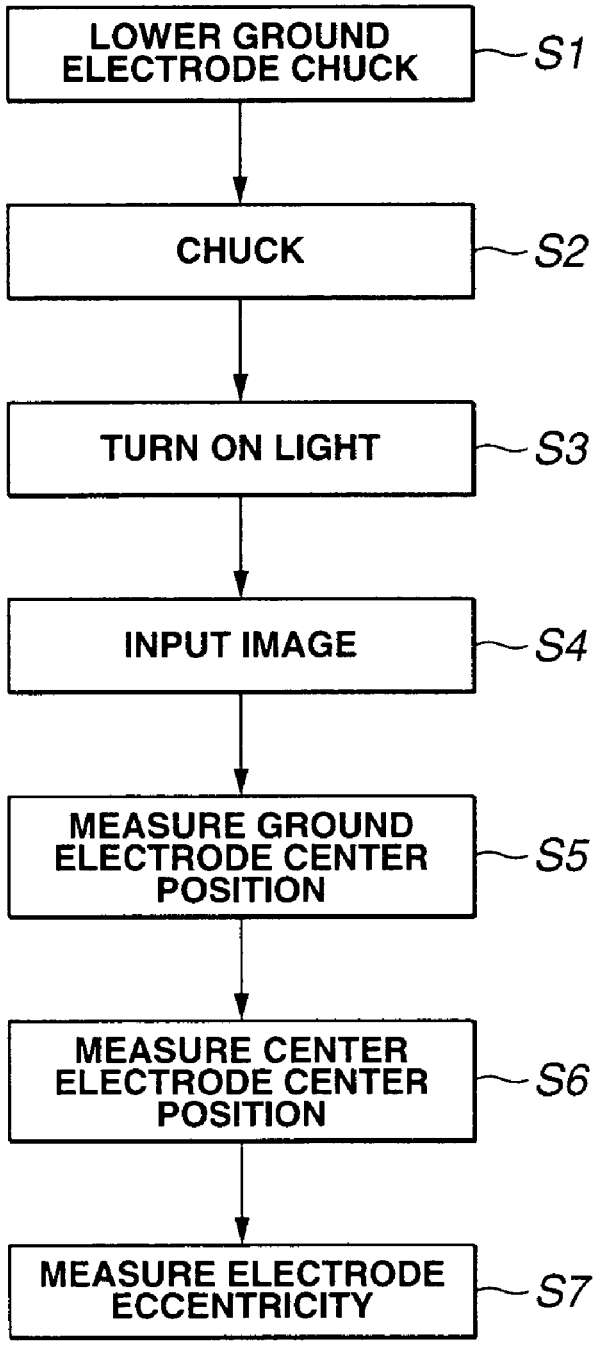
FIG. 6 is a flowchart briefly showing a method of making a spark plug by using the adjustment bending device of FIG. 2.
Figure 7:
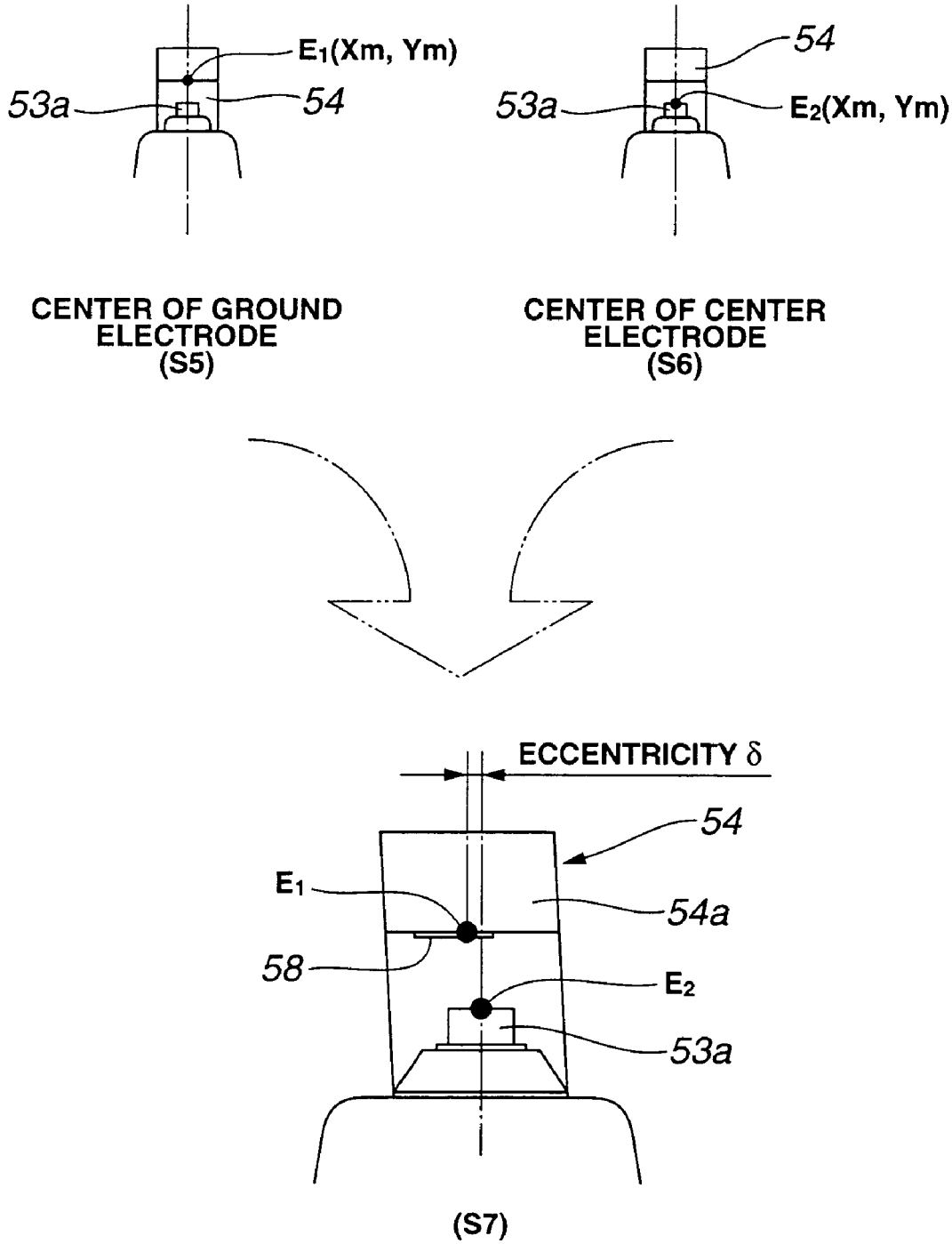
FIG. 7 is a view showing the important points of the method of FIG. 6.
Figure 8:
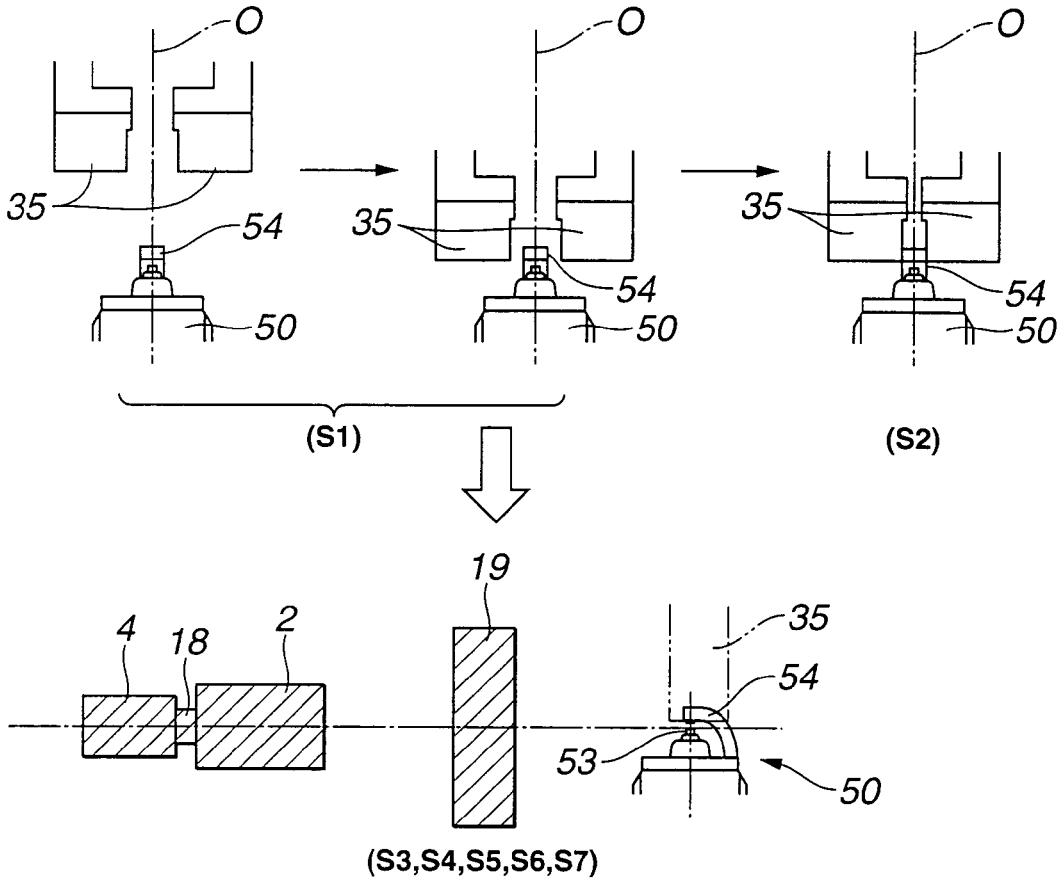
FIG. 8 is a view showing the important steps of the method of FIG. 6.

Then, the holder 31 shown in FIG. 4 is attached to a base (not shown) of the adjustment bending device 5 (refer to FIG. 5) and the work 50 is attached to the holder 31 by using the work loading/unloading mechanism 14 (refer to FIG. 2) that is constituted by a known robot arm mechanism, etc. The process steps onward are shown in FIG. 6. Further, FIGS. 7 and 8 illustrate selected main process steps. In steps S1 and S2 of FIG. 6, the work 50 attached to the holder 31 is disposed so as to allow the leading end surface 54*a* to face the camera 4, i.e., to orient the frontal direction (refer to FIG. 1). Concretely, as shown in (S1) and (S2) of FIG. 8, the chuck 35 is moved down toward the ground electrode 54 and chuck or clamp the ground electrode 54 through sideway movement of chuck elements toward the ground electrode 54 from the opposite directions. The grasping surfaces of the chuck 35 are set so as to face the above-described frontal direction so that the work 50 orients the frontal direction when clamped by the chuck 35.

Referring again to FIG. 6, when the above-described disposition of the work 50 is completed, the program proceeds to step S3 where the light 19 is turned on. In step S4, an image captured by the camera 4 is inputted to the computer 10 (refer to FIG. 2) and stored in the memory 200. Then, in step S5 (refer to FIGS. 7 and 8 additionally), a center position of a leading end surface 54*a* edge of the ground electrode 54 in the width direction thereof, which edge borders the spark gap g, i.e., a center electrode center position E1 (Xm, Ym) is obtained based on the image VA and stored in the memory 211 (in this embodiment, the reference direction on the display screen is set as an y-axis and the direction perpendicular thereto is set as x-axis).

In step S6 (refer to FIGS. 7 and 8 additionally), a center position of a leading end surface edge of the center electrode 53, i.e., the center electrode center position E2 (Xm, Ym) is obtained based on the display image VA and stored in the memory 212. Then, in step S7, the eccentricity δ between the both electrodes is measured or calculated by using the ground electrode center position E1 and the center electrode center position E2 and stored in the memory 221. Namely, it is determined whether the X-coordinate of the center electrode center position E2 is located on the right side or on the left side of the X-coordinate of the ground electrode center position E1 and the sign of the eccentricity δ is determined. The sign defines the direction of the bending process of the ground electrode 54. The eccentricity δ is calculated from the difference between the X-coordinate of the ground electrode center position E1 and the x-coordinate of the center electrode center position E2.

Hereinafter, the adjustment bending process will be described.

The adjustment bending process is carried out by using the adjustment bending device 5 shown in FIG. 5. In this process, adjustment bending of the ground electrode 54 by an adjustment amount μ is performed in the direction to eliminate the eccentricity δ, i.e., to make the eccentricity δ become zero. Concretely, the adjustment bending process is performed by using the main control section of FIG. 2. Ground electrodes 54 of a plurality of works 50 are processed by adjustment bending of various adjustment amounts μ and the resulting displacement amounts λ of the ground electrode 54 are actually measured. From this, the adjustment amount μ is determined beforehand as a function of the displacement amount λ, i.e., μ=F(λ) (adjustment amount function). Namely, by experimentally determining the adjustment amount μ so as to be obtained from the adjustment amount function μ=F(λ) of only the displacement amount λ, thereby determining the function in view of the spring back amount from the first, the adjustment amount μ corresponding to the measured eccentricity δ can be found from the adjustment amount function μ=F(λ). Namely, by substituting λ of the adjustment functions μ=F(λ) for δ, the adjustment amount μ can be determined with ease.

Upon actual manufacturing of spark plugs, the works have different eccentricities δ and each undergoes each adjustment bending process of a corresponding adjustment amount μ. After the adjustment bending process, the eccentricity is measured again. If the measured eccentricity is δ', the actual displacement amount λ of the ground electrode 54 can be obtained from the following expression by using the eccentricity that was measured before the adjustment bending process.

$$\lambda=\delta-\delta' \quad (5)$$

where the parameters representative of the eccentricity have plus or minus signs so as to indicate the directions of the eccentricities by those signs.

Accordingly, by the above-described measurement of $\lambda$, the set of data of the adjustment amount $\mu$ and the displacement amount $\lambda$ can be updated by the data ($\mu$, $\lambda$) newly collected at the time of manufacturing the spark plug. By using the adjustment amount function $\mu=F(\lambda)$ while updating the same based on the updated sets of ($\mu$, $\lambda$) data, the accuracy in determination of $\mu$ by the function $\mu=F(\lambda)$ can be made further higher.

In this instance, the adjustment amount function $\mu=F(\lambda)$ for determining the adjustment amount $\mu$ for the work that is being manufactured at present can be obtained based on all the data sets for the works prior to the present work. However, if it is considered that $\mu=F(\lambda)$ has an inclination that varies with the lapse of time, it is desired to determine the adjustment amount $\mu$ by using the sets of ($\mu$, $\lambda$) data of a predetermined number (n-number) of works immediately before the present work.

The adjustment function $\mu=F(\lambda)$ can be obtained as a function of a first digit by performing the least square regression of the set of ($\mu$, $\lambda$) data of the adjustment amount $\mu$ and the displacement amount $\lambda$. This method is very useful when $\lambda$ is considered to tend to increase nearly in proportion to $\mu$ within the range of the adjustment amount $\mu$ that has a possibility of being employed in manufacture. However, this tendency is supposed to vary within a predetermined range depending upon the condition of the ground electrode before bending and the composition of the material of the same. Accordingly, approximation by the least square regression is desire to be made based on an increased number (for example, five or more) of sets of ($\mu$, $\lambda$) data.

When the collected ($\mu$, $\lambda$) data increase in number upon progress of the actual manufacture of spark plugs, the accuracy of the above-described approximation by the least square regression is inevitably made higher. However, immediately after beginning of the manufacture, it is difficult to collect sufficient sets of ($\mu$, $\lambda$) data. Accordingly, prior to the manufacture of a spark plug, it is necessary to collect the sets of ($\mu$, $\lambda$) data of a predetermined number of works by experiment or the like. However, the number of sets of ($\mu$, $\lambda$) data that can be collected by experiment or the like is limited.

Figure 10:
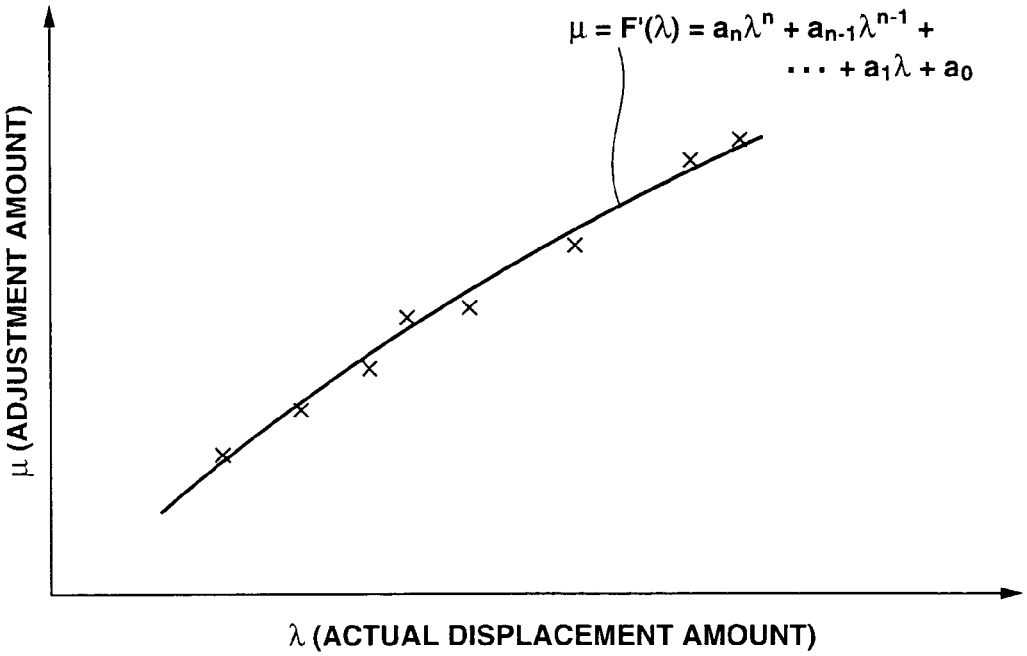
FIG. 10 is a view conceptually showing an example of a method of determining an initial approximation function $\mu=F'(\lambda)$.

Thus, the following method can be employed to this end. Until sufficient sets of data (e.g., n-sets of data) are obtained, n-sets of ($\mu$, $\lambda$) data are obtained beforehand by experiment. By using the data obtained by the experiment, the initial approximation function $\mu=F'(\lambda)$ is obtained. For example, as shown in FIG. 10, the initial approximation function $\mu=F'(\lambda)$ can be obtained as a function of the n-th degree that is determined by using the sets of ($\mu$, $\lambda$) data of n-number of works. After the beginning of the manufacture of the spark plug, the function of the n-th degree is used for obtaining the adjustment amount $\mu$ till the n-th work is manufactured after the beginning of the manufacture of the spark plug. By doing so, the accuracy in determination of the adjustment amount $\mu$ can be maintained relatively high even in the initial stage of manufacture in which the collected data are few.

On the other hand, for the n+1-th work and onward, the adjustment amount function $\mu=F(\lambda)$ is obtained as a linear function of $\lambda$ that is obtained by doing the least square regression with respect to all the data sets of the works prior to the present work or the data sets of a predetermined number of works immediately before the present work, and by using the adjustment amount function the adjustment mount $\mu$ is obtained. When the data points increase sufficiently, the accuracy in determination of $\mu$ by using the least square regression can be made higher and furthermore the calculation can be considerably easier than polynomial approximation.

In case, for example, n-sets of ($\mu$, $\lambda$) data are obtained by experiment, measurement of $\lambda$ is performed by changing $\mu$ little by little and the above-described polynomial approximation can be made with respect to the result of measurement. However, different works may cause different $\lambda$ for the same $\mu$, so that it is desired that the initial approximation function $\mu=F'(\lambda)$ reflects an average inclination of variation of $\lambda$. Thus, it is effective to prepare a plurality of works, obtain displacement amounts $\lambda$ resulting when a plurality of predetermined adjustment amounts $\mu$ are applied to the respective works and perform the polynomial approximation by using the average $\lambda$ for each adjustment amount $\mu$.

Figure 11:
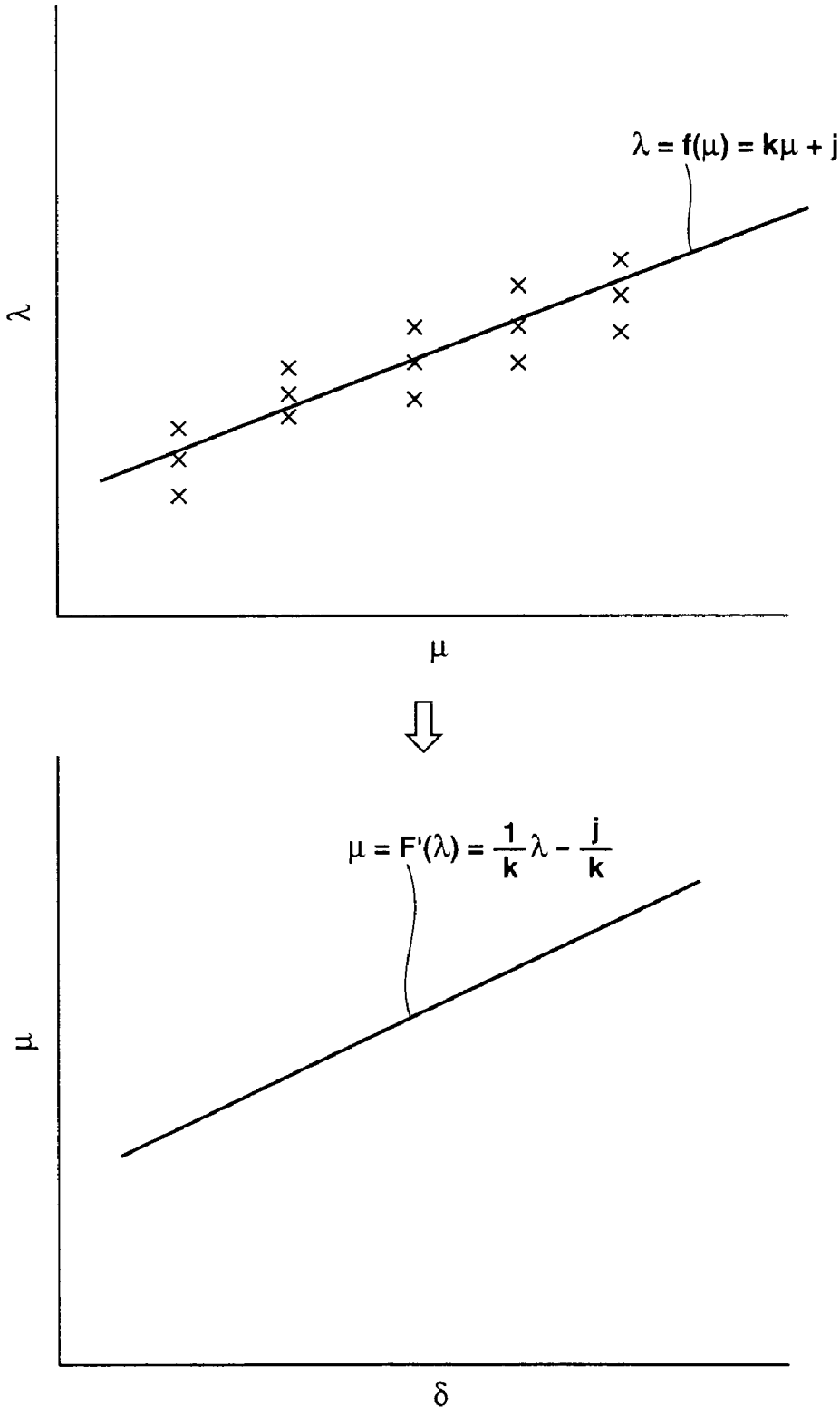
FIG. 11 is a view conceptually showing another example of a method of determining an initial approximation function $\mu=F'(\lambda)$.

Further, in case displacement amounts $\lambda$ of a plurality of works for each of a plurality of adjustment amounts $\mu$ are measured, the initial approximation function $\mu=F'(\lambda)$ can be obtained as a linear function by not averaging $\lambda$ for each $\mu$ but by determining a least square regression line on the basis of those sets of ($\mu$, $\lambda$) and obtaining the initial approximation function $\mu=F'(\lambda)$ as a linear function as shown in FIG. 11. Since a plurality of displacement amounts $\mu$ are measured for each $\lambda$, an influence of variation can be reduced and $\mu$ can be determined with a relatively high accuracy by means of an easy method of minimum square approximation even at a stage immediately after the beginning of manufacture where the data points are few. In this instance, to obtain the regression line of the adjustment amount $\mu$ on the basis of the displacement amount $\lambda$, i.e. $\lambda=f(\mu)$ by least square regression and obtain the initial approximation function $\mu=F'(\lambda)$ as an inverse function of $\lambda=f(\mu)$ is desired since in the experiment for determining the function approximation is made with the assumption that the adjustment amount to be applied is a true value and by considering a displacement ratio as a random variable and therefore determination of the function can be attained with a high accuracy.

In any event, the method of using the initial approximation function is an expedient means for determining the adjustment amount as accurate as possible immediately after the beginning of manufacture at which the data points are few. Accordingly, after sufficient data points are collected, it is desired that the control proceeds to the process for determining the adjustment amount function $\mu=F(\lambda)$ by the least square regression based on the collected data. However, in case a variation of $\lambda$ for $\mu$ is sufficiently small, the initial approximation function can be used constantly.

Figure 9:
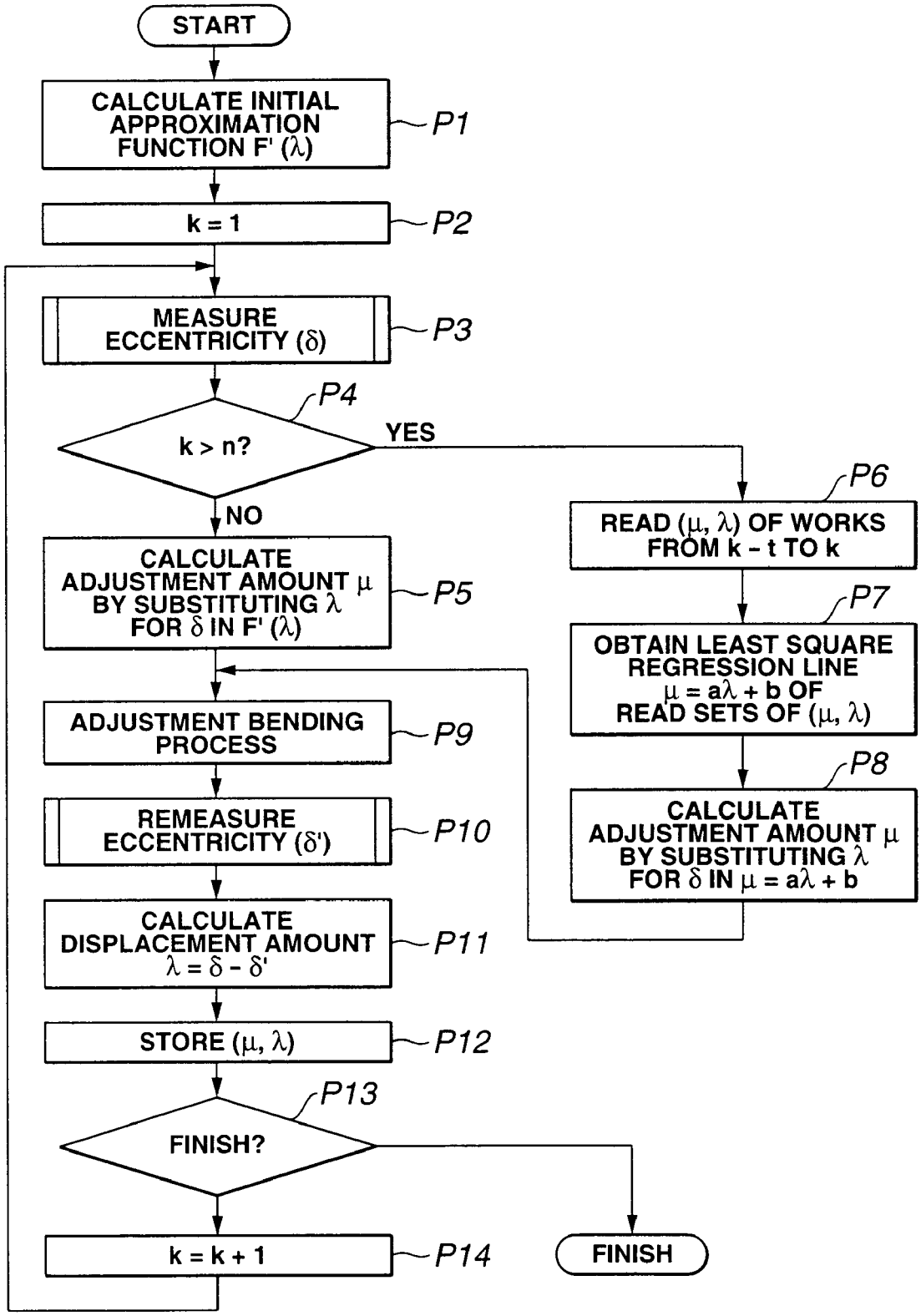
FIG. 9 is a flowchart showing an adjustment bending process according to an embodiment of the present invention.

FIG. 9 shows a control routine that is executed by the computer 10 (i.e., the control software 230) for determining the above-described adjustment amount $\mu$. Firstly, in step P1, the initial approximation function $\mu=F'(\lambda)$ is obtained prior to manufacture and by using n-number of works for experiment and stored in the memory 225. In step P2, a work number k is regarded as 1. In step P3, the eccentricity is measured by the process having been described hereinbefore. In step P4, it is determined whether the work number k exceeds n. If the answer in step P4 is negative, the program proceeds to step P5 where the adjustment amount $\mu$ is calculated by using the initial approximation function $\mu=F'(\lambda)$ and stored in the memory 222.

Then, the program proceeds to step P9 where the adjustment bending process of the ground electrode 54 is performed based on the calculated adjustment amount $\mu$. In step P10, the eccentricity of the processed work is remeasured and is set as $\delta'$. Further, in step P11, the displacement amount $\lambda$ is obtained from $\delta-\delta'$ and ($\mu$, $\lambda$) value is stored in the memory 226 (P12). If there is no interruption of finish in step P13, the program proceeds to step P14 where increment of the work number k is executed and the work is changed to the next one. Then, the steps P3 and onward are repeated.

When the answer in step P4 is affirmative, i.e., it is determined in step P4 that the work number k exceeds n, the program proceeds to step P6 where t-sets of (μ, λ) data for the works immediately before the work of the work number k are read. Then, in step P7, a least square regression line $\mu=a\lambda+b$ for the t-sets of (μ, λ) data is obtained, then set as an adjustment amount function and stored in the memory 227. In step P8, the adjustment amount μ is calculated by substituting λ of $\mu=a\lambda+b$ for δ and stored in the memory 222.

In the meantime, the step for remeasuring the eccentricity after the adjustment process can be used as a kind of inspection step. Namely, selection of thee works can be done by using the result of remeasurement of the eccentricity as the result of inspection. The works whose remeasured eccentricities are out of required limits are determined as defective articles and removed from a lot production line. The removed defective articles can, for example, undergo an additional adjustment bending process so as to allow the eccentricities thereof to be within the required limits thereby being changed into good articles.

Figure 15:
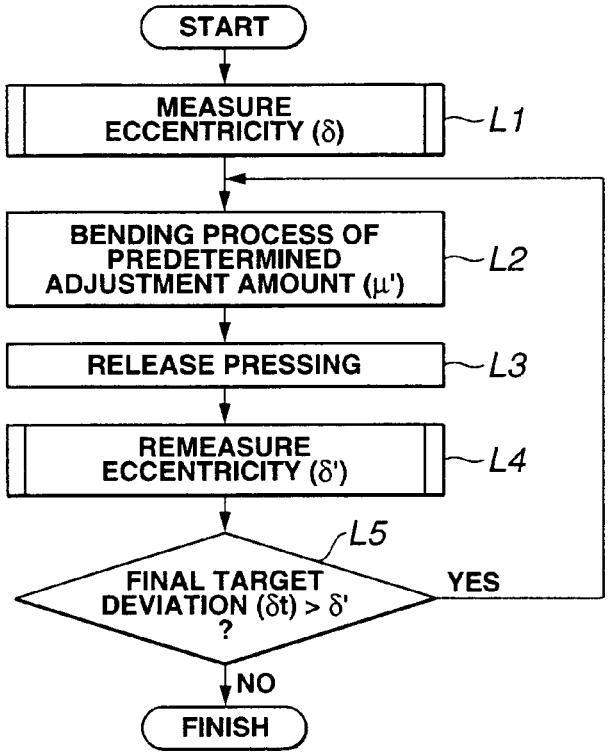
FIG. 15 is a flowchart showing an adjustment bending process according to another embodiment of the present invention.

Further, the above-described variation of the main control section shown in FIG. 14 can be used. FIG. 15 shows a control routine that is executed by the computer 10 (i.e., control software 230') for performing the above-described adjustment bending process. Firstly, in step L1, measurement of the eccentricity δ is performed by the process having been described hereinbefore. The program then proceeds to step L2 where the ground electrode 54 undergoes the adjustment bending process of the adjustment amount μ' that is stored beforehand in the memory 223. Then, the program proceeds to step L3 where the drive motor 8 is once driven in the reverse direction thereby releasing the ground electrode 54 from the pressing by the bending tool 32. In step L4, the eccentricity of the work is remeasured and its value is set as δ'. In step L5, δ is compared with a target deviation δt. If the remeasured value δ' is larger than the target deviation δt, the steps L2 and onward are repeated. Further, if the remeasured value δ' is smaller than the target deviation δt, the adjustment bending process is finished.

Figure 13A:
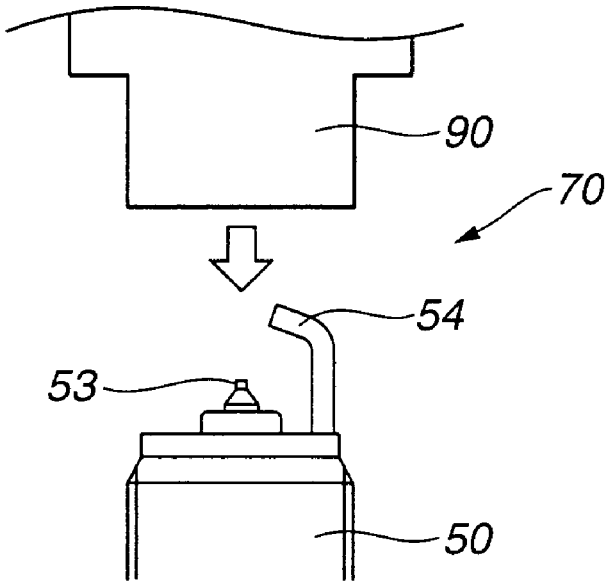
FIGS. 13A and 13B are views of an adjustment pressing device.
Figure 13B:
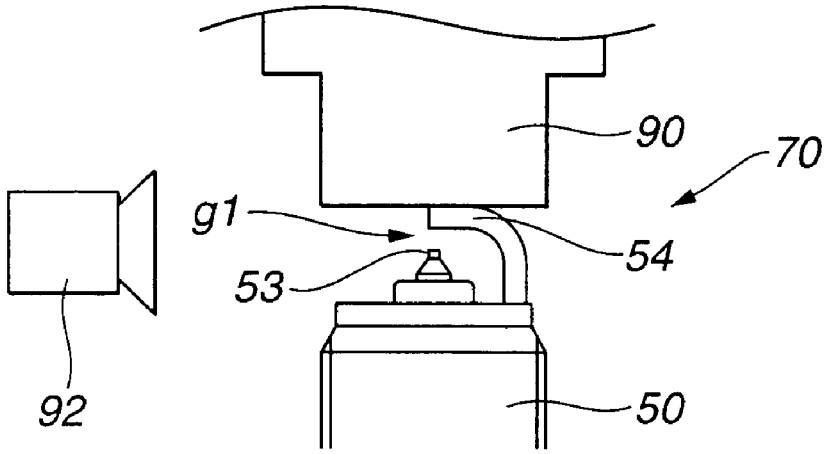
Figure 16:
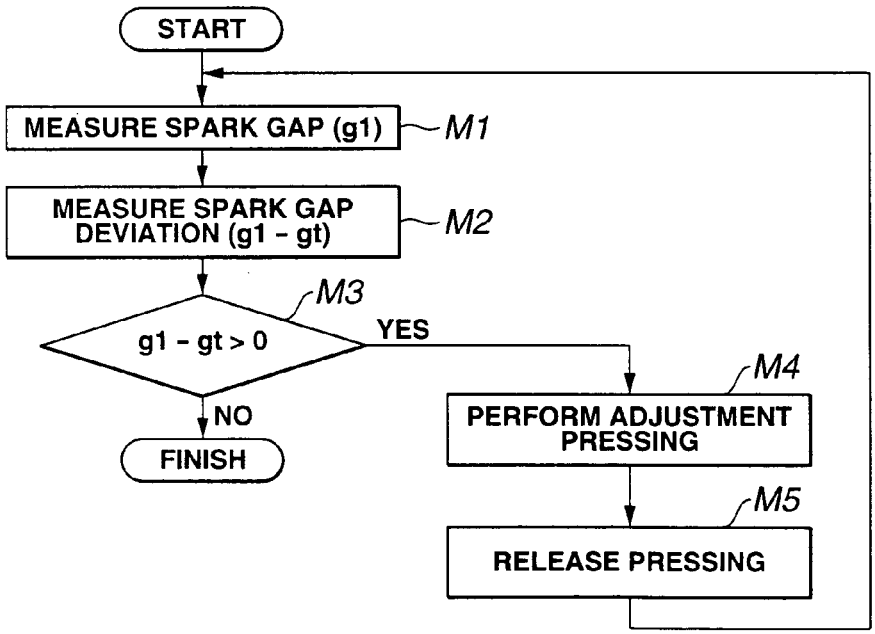
FIG. 16 is a flowchart showing an process for remeasuring a spark gap g after the adjustment bending process is completed.

After the adjustment bending process is finished, the spark gap g1 is remeasured. If the remeasured spark gap g1 has not reached a target spark gap gt, the adjustment pressing process shown in FIGS. 13A and 13B is performed so as to adjust the spark gap to a final value. FIG. 16 shows an example of control for the adjustment pressing process. Firstly, in step M1, a spark gap g1 is measured. Since the method for measurement of the spark gap is known as disclosed in Japanese patent provisional publication No. 11-121143, detailed description thereto is omitted. Then, the program proceeds to step M2, a deviation of the spark gap g1 from the target spark gap gt, i.e., (g1−gt) is measured. Then, the program proceeds to step M3 where it is determined whether (g1−gt) is larger than 0 (zero). If (g1−gt) is larger than zero, it is found that the spark gap has not decreased to the target spark gap gt even by the adjustment pressing process in the previous step. Thus, the program proceeds to step M4 where the adjustment pressing is performed so as to decrease the spark gap. After the adjustment pressing is released in step M5, the program returns to step M1 to repeat the steps M1 and onward. In the meantime, at the time of adjustment pressing, it will do to perform pressing of a pressing amount that is determined by consideration of spring back that is known as disclosed in Japanese patent provisional publication No. 2000-164322. Further, if the gap deviation (g1−gt) is smaller than zero, it is found that the spark gap has decreased to the target spark gap gt, so that the control is finished.

The entire contents of Japanese Patent Application P2002-184387 (filed Jun. 25, 2002) are incorporated herein by reference.

Although the invention has been described above by reference to a certain embodiment of the invention, the invention is not limited to the embodiment described above. Modifications and variations of the embodiment described above will occur to those skilled in the art, in light of the above teachings. For example, while in the provisional pressing process of the above-described embodiment, the shape of the provisional pressing spacer 42 is selected suitably and the spacer 42 of a suitably selected shape is used for performing a provisional pressing process and thereby decreasing the spark gap of the spark plug work to a predetermined value larger than a target spark gap gt, the spark gap can be adjusted to the target gap gt by the image processing. The scope of the invention is defined with reference to the following claims.

What is claimed is:

1. A method for making a spark plug having a center electrode disposed inside an insulator, a metallic shell disposed outside the insulator, and a ground electrode having a base end side connected to a leading end surface of the metallic shell and a leading end side bent so as to have a side surface that is opposed to a leading end surface of the center electrode to form therebetween a spark gap, the method comprising the steps of:

for adjustment of a spark gap of a spark plug work having the center electrode and the ground electrode, provisionally pressing the ground electrode of the spark plug work toward the leading end surface of the center electrode and thereby decreasing the spark gap to a predetermined value larger than a final target gap gt;

after the step of provisionally pressing the ground electrode, performing an adjustment bending process for bending the ground electrode in the widthwise direction thereof so as to eliminate an eccentricity δ of the ground electrode with respect to a target position;

after the step of performing the adjustment bending process, measuring a spark gap g1 of the spark plug work and measuring a difference (g1−gt) between the measured spark gap g1 and the final target gap gt; and pressing the ground electrode toward the center electrode when the difference (g1−gt) is positive;

wherein the widthwise direction is different than the direction of pressing the ground electrode toward the center electrode.

2. A method according to claim 1, wherein the step of performing the adjustment bending process comprises performing the adjustment bending process for ground electrodes of a plurality of spark plug works to adjust positions of the ground electrodes in the width direction thereof by adjustment amounts μ, measuring resulting displacement amounts λ of the ground electrodes in a pressed direction, finding the adjustment amount λfrom an adjustment amount function $\lambda=F(\mu)$ that is a function of the displacement amount λ, and finding, based on the adjustment amount function $\lambda=F(\mu)$, the adjustment amount μ necessary for eliminating the eccentricity δ of the ground electrode with respect to the target position.

3. A method according to claim 2, wherein the step of performing the adjustment bending process comprises updating sets of (μ,λ) data of the adjustment amount μ and the displacement amount λ by (μ,λ) data newly collected upon manufacture of the spark plug, and using while updating the adjustment amount function μ=F(λ) based on the updated sets of (μ,λ) data.

4. A method according to claim 3, wherein the step of performing the adjustment bending process comprises obtaining the adjustment amount function μ=F(λ) based on the sets of (μ,λ) data of all of the spark plug works preceding a present spark plug work.

5. A method according to claim 3, wherein the step of performing the adjustment bending process comprises obtaining the adjustment amount function μ=F(λ) based on the sets of (μ,μ) data of a predetermined number of the spark plug works immediately before a present spark plug work.

6. A method according to claim 1, wherein the step of performing the adjustment bending process comprises obtaining the adjustment amount function μ=F(λ) as a linear function of λ by least square regression of the sets of (μ,λ) data of the adjustment amount μ and the displacement amount λ.

7. A method according to claim 6, further comprising the steps of:

prior to beginning of manufacture of the spark plug, obtaining an initial approximation function μ=F'(λ) as a function of n-th degree by using the sets of (μ,λ) data having been obtained beforehand with respect to a predetermined n-number of spark plug works, and for the spark plug works till the n-th after beginning of manufacture, finding the adjustment amount μ from the initial approximation function μ=F'(λ); and for the spark plug works from n+1-th onward after beginning of manufacture, obtaining the adjustment amount function μ=F(λ) as a linear function of λ by least square regression of the sets of (μ,λ) data of all of the spark plug works prior to a present spark plug work and finding the adjustment amount μ from the adjustment amount function μ=F(λ).

8. A method according to claim 7, wherein the step of obtaining the initial approximation function comprises preparing a required number of spark plug works for experiment, making adjustments of a plurality of predetermined adjustment amounts μ to the respective spark plug works to obtain resulting displacement amounts λ, and obtaining, by least square regression of thus obtained sets of (μ,λ) data, the initial approximation function μ=F'(λ) as a linear function of λ.

9. A method according to claim 8, wherein the step of obtaining the initial approximation function comprises obtaining, by the least square regression, a regression line λ=f(μ) for regression of the displacement amounts λ to the adjustment amount μ, and obtaining the initial approximation function μ=F'(λ) as an inverse function of λ=f(μ).

10. A method according to claim 6, further comprising the steps of:

prior to beginning of manufacture of the spark plug, obtaining an initial approximation function μ=F'(λ) as a function of n-th degree by using the sets of (μ,λ) data having been obtained beforehand with respect to a predetermined n-number of spark plug works, and for the spark plug works till the n-th after beginning of manufacture, finding the adjustment amount μ from the initial approximation function μ=F'(λ); and for the spark plug works from n+1-th onward after beginning of manufacture, obtaining the adjustment amount function μ=F(λ) as a linear function of λ by least square regression of the sets of (μ,λ) data of all of the spark plug works prior to a present spark plug work and finding the adjustment amount μ from the adjustment amount function μ=F(λ).

11. A method according to claim 10, wherein the step of obtaining the initial approximation function comprises preparing a required number of spark plug works for experiment, making adjustments of a plurality of predetermined adjustment amounts μ to the respective spark plug works to obtain resulting displacement amounts λ, and obtaining, by least square regression of thus obtained sets of (μ,λ) data, the initial approximation function μ=F'(λ) as a linear function of λ.

12. A method according to claim 11, wherein the step of obtaining the initial approximation function comprises obtaining, by the least square regression, a regression line λ=f(μ) for regression of the displacement amount λ to the adjustment amount μ, and obtaining the initial approximation function μ=F'(λ) as an inverse function of λ=f(μ).

13. A method according to claim 1, wherein the step of measuring the spark gap and the step of pressing the ground electrode are repeated until the spark gap is adjusted to the final target gap gt.

14. A method according to claim 1, wherein the step of performing the adjustment bending process is repeated until the eccentricity δ is adjusted to a final target deviation δt.

15. A method of making a spark plug having a center electrode and a ground electrode having a base end side joined to an end surface of a metallic shell and a leading end side opposed to the center electrode so as to form a spark gap therebetween, the method comprising:

performing an adjustment bending process of a plurality of spark plug works having the center electrodes and the ground electrodes for making adjustments of positions of the ground electrodes in the width direction thereof by an adjustment amount μ;

measuring resulting displacement amounts λ of the ground electrodes in the width direction thereof and finding the adjustment amount μ from μ=F(λ) that is a function of the displacement amount λ; and finding an adjustment amount necessary for eliminating the eccentricity δ of the ground electrode with respect to a target position based on the adjustment amount function μ=F(λ);

wherein the width direction of the ground electrodes is different than a direction of the spark gap.

* * * * *